US006575758B1

(12) United States Patent
Hastings

(10) Patent No.: US 6,575,758 B1
(45) Date of Patent: Jun. 10, 2003

(54) DISPLAY HOLDER AND METHOD FOR USING SAME

(76) Inventor: John T. Hastings, 84. E. 205th St., Euclid, OH (US) 44123

( * ) Notice: Subject to any disclaimer, the term of this patent is extended or adjusted under 35 U.S.C. 154(b) by 81 days.

(21) Appl. No.: 08/867,949

(22) Filed: Jun. 3, 1997

(51) Int. Cl.[7] ..... G09F 19/22
(52) U.S. Cl. ..... 434/430; 434/408
(58) Field of Search ..... 434/88, 370, 408, 434/430, 413

(56) References Cited

U.S. PATENT DOCUMENTS

| | | | | | |
|---|---|---|---|---|---|
| 4,226,029 | A | * | 10/1980 | McGuire | 434/88 |
| 4,245,401 | A | * | 1/1981 | Riehle | 434/80 |
| 4,403,000 | A | * | 9/1983 | Gates | 434/430 |
| 4,838,793 | A | * | 6/1989 | Taylor | 434/430 |
| 5,080,590 | A | * | 1/1992 | Frisque | 434/88 |
| 5,110,295 | A | * | 5/1992 | Conera | 434/370 |
| 5,207,582 | A | * | 5/1993 | Michelson | 434/408 |
| 5,393,232 | A | * | 2/1995 | Haines | 434/434 |
| 5,533,902 | A | * | 7/1996 | Miller | 434/430 |
| 5,622,504 | A | * | 4/1997 | Hance | 343/430 |

OTHER PUBLICATIONS

EASYBOARD Trademark of Easyboard, Inc., Richmond Heights, Ohio 44143.

* cited by examiner

*Primary Examiner*—Paul J. Hirsch
(74) *Attorney, Agent, or Firm*—Jansson, Shupe & Munger, Ltd.

(57) ABSTRACT

A display frame for securing a document to a rigid surface and a method for using same are disclosed. The frame includes a plurality of fastener elements preferably made from hook type sections of hook and loop fastener material, although magnetic or low tack adhesive fasteners may also be used. The rigid surface may be a portable board or a wall, the same display frame being usable on both types of rigid surface. The fastener elements on the frame limit relative movement between the document and the frame to simplify the attachment of the document and frame to the rigid surface.

14 Claims, 5 Drawing Sheets

DISPLAY HOLDER AND METHOD FOR USING SAME

The present invention is directed toward a display holder for holding and displaying sheets of paper or similar material and more specifically, toward a display holder which includes an erasable overlay for annotating the material being displayed and a method for using this display holder.

BACKGROUND OF THE INVENTION

Graphs, charts and other displays are frequently used during informational presentations to explain or emphasize important points. These displays may consist of drawings on a chalkboard, images projected on a screen, or drawings on a large pad of paper supported by an easel. All of these traditional display methods have drawbacks, especially for presenting information to a small group of people where the need to draw figures and change slides can distract from the content of the presentation. Slides and transparencies also require special preparation in that a projector and a screen must be obtained and set up before a meeting, and:the information to be displayed must be embodied in a slide or transparency. Chalkboards are bulky and drawings on easels cannot be readily modified. These displays are best suited to classrooms where a large number of people are present and/or where the same information must be presented over and over to different groups of people.

Displays for use with small groups of people are often printed on relatively small sheets of paper, such as 8½ inches by 11 inches or 11 inches by 17 inches. The increased use of computers having sophisticated graphics capabilities, and the availability of low cost color printers, make it easier for individuals to prepare these paper displays. This gives the person preparing the information greater control over its format and allows for rapid and accurate changes. Displays prepared in this manner can be difficult to exhibit, however, because the paper on which they are printed is not rigid. These paper displays must be taped to a wall or tacked to a board or alternately, passed around for individuals to examine. These presentation methods can damage the displays and distract from the presentation itself. Furthermore, it is often desirable to modify a display during a presentation to emphasize key points or to show how new factors could change an analysis. This is easy to do on a chalkboard but cannot be done on sheets of paper without permanently altering the display.

To overcome these problems, small display boards or frames have been used to hold and display pieces of paper. These devices may also include an erasable overlay for allowing a user to annotate a display without damaging it. While these prior art devices solve some of the aforementioned problems, they are not ideal and often create additional problems. For example, U.S. Pat. No. 4,741,119 to Baryla relies on an electrostatic charge to hold a piece of paper against a board and to hold a thin plastic film over the paper. However, this arrangement will not work well with certain materials such as cardboard or photographs which may not be strongly attracted by the electrostatic charge. In addition, the charge can make multiple papers stick together or stick to the plastic cover. This can make it difficult to switch the papers being displayed. Other displays, such as the one shown in U.S. Pat. No. 5,025,581 to Polzin, comprise a pocket having a clear front window into which documents can be inserted. However, it can be difficult to insert multiple documents using this arrangement without bending their corners or otherwise damaging them. The rapid switching of documents is also very difficult. This display does not lend itself to settings where a number of pieces of information must be displayed in quick succession. It is also difficult to open these prior displays, remove one paper, insert another and close the display unless the display is laid on a flat surface. This makes it difficult for a speaker standing before an audience to quickly change to a new figure. Therefore, it is desirable to provide a display board that is lightweight, easy to use, capable of displaying paper, photographs and other materials, and which allows for the erasable annotation of the material being displayed.

It is also often desirable to display information on a fabric covered wall, such as the wall of an office cubicle, or on a fabric covered pin board or similar fabric covered surface. This is usually accomplished by using pins or thumb tacks. However, pins and tacks make holes in the document being displayed. When the document is frequently removed and reattached to the wall, the large number of holes made by the pins can weaken the corners of the document and make it unsightly. Additionally, if the document is pulled off of the wall without first removing the pins, the corners of the document will be ripped. Documents can also be taped to walls, but this too can damage the documents. Therefore, it is desirable to provide a display holder that can be used to display a document on a fabric covered wall that will not damage the document, and which holder can also be used in conjunction with the display holder described above.

SUMMARY OF THE INVENTION

The present invention solves these and other problems by providing a cover that can be placed over a document to secure it to a lightweight board or to a suitable wall while allowing the information thereon to be seen. The cover may comprise a frame which is open in the middle to leave the displayed document exposed, or it may cover the entire sheet but have a transparent central portion which can be written upon with an erasable marker to annotate the display. In one embodiment, the invention uses hook and loop fastening material, such as Velcro brand, to secure the frame or cover to a board or fabric covered surface. This material allows the cover to be quickly and easily secured to and removed from the board or surface to hold one or more pieces of paper or other material between the cover and the surface. Other embodiments use magnets on the cover or low tack adhesive material on the board to secure the cover to the board.

Hook and loop fasteners will not damage documents the way that glue or tacks can, and in addition, the hook and loop fasteners are raised with respect to the supporting board to define a placement area for the material to be displayed. The hook and loop fasteners prevent the paper or other material from sliding relative to the board while the display is assembled. The fasteners therefore allow the board to be held at an angle or in a vertical orientation before the cover is attached. Thus, the unit can be opened and closed easily without first laying it on a horizontal surface as was often necessary with prior art displays. In addition, the display holder can be constructed so that each pair of fasteners can be engaged or disengaged independently of the other pairs. This allows one pair to be disengaged to form an opening to allow documents to be inserted or removed from the holder without disassembling the entire display. When the cover is made from a flexible material, this arrangement also allows all but one of the fastener pairs to be disengaged so that the cover can be folded out of the way about the remaining fastener pair to allow a paper or papers to be inserted. A two-sided display can also be made by providing fasteners on both sides of a board and using two separate covers.

Alternately, a board may be provided with a brace to make it freestanding or a hook to allow it to be mounted on a wall. The board is also rigid and durable and can be passed from person to person during a presentation when this is desired. Alternately, the same cover can be attached directly to a fabric covered wall, such as in a cubicle, and used as a presentation frame to display items in a more permanent manner.

In a second embodiment, fasteners are disposed about the cover on only three sides which leaves an opening between the cover and board or surface along one side of the cover, preferably the top. This allows rigid material such as paperboard or photographs to be inserted and removed through the opening without removing the cover from the board or wall when this is desired. The cover can also be separated from the board or wall as in the first embodiment when the materials being displayed might be damaged by insertion through an opening or when multiple sheets of material are contained in the holder.

In a third embodiment, loop type fasteners are provided on both the front and rear surfaces of the board and two covers are used to provide a two-sided display.

In a fourth embodiment, the hook and loop fasteners are replaced with magnets or a magnet and a ferromagnetic material. Importantly, the magnetic or ferromagnetic material on the underlying board is raised with respect to the board and serves to prevent a paper from sliding off of the board in the same manner as the raised hook and loop fasteners. The magnets may be present on three or four sides of the cover as described above with respect to the hook and loop fasteners.

In a fifth embodiment, the fasteners comprise raised members on a board, such as sections of a foam-like material, having a low tack adhesive on their upper surfaces for engaging the cover. As used herein, a "low tack" adhesive is one that is easily removable from many surfaces such as the adhesive found on the back of removable notes. The foam is raised with respect to the board and so serves to retain a paper as described above. This adhesive removably holds the cover in place and the invention functions as described above.

The cover of the first or second embodiment can also be used without the underlying board to secure a document to a fabric covered wall such as the wall of an office cubicle or a fabric pin board. In this manner, many of the advantages described with respect to the display holder above can be realized on any fabric covered surface. The cover preferentially includes three sections of fastening material, one on each of the bottom, left and right sides leaving the top open for the insertion of documents. Fastening material can also be provided along the top edge for greater security. The cover of the fourth embodiment can be used in the same manner to hold documents to a ferromagnetic surface such as the surface of certain chalk boards.

It is therefore the principal object of the present invention to provide a holder for displaying paper or similar materials.

It is another object of the present invention to provide a display holder which includes an erasable overlay for annotating information being displayed without altering the original information.

It is a further object of the present invention to provide a display holder which includes elements to help align the material in the holder.

It is another object of the present invention to provide a method of using a display holder to secure a document in a fixed relationship to a wall.

It is still another object of the present invention to provide a method of positioning a document and display holder on a wall.

It is yet another object of the present invention to provide a display holder for protecting the documents being displayed from physical damage.

It is yet a further object of the present invention to provide a display holder having an erasable overlay which can be partially detached from a support surface to allow documents to be inserted into or removed from behind the cover.

It is another object of the present invention to provide a display holder for mounting a document on a fabric covered surface.

It is still a further object of the present invention to provide a display holder which can be opened and closed while being held by a user without first laying the display on a horizontal surface.

It is still another object of the present invention to provide a display holder that can be used as a frame for mounting documents on a ferromagnetic surface.

BRIEF DESCRIPTION OF THE DRAWINGS

These and other objects of the present invention will be appreciated from a reading and understanding of the following detailed description of the preferred embodiments of the invention, together with the following drawings of which.

DETAILED DESCRIPTION OF THE PREFERRED EMBODIMENTS

Figure 1:
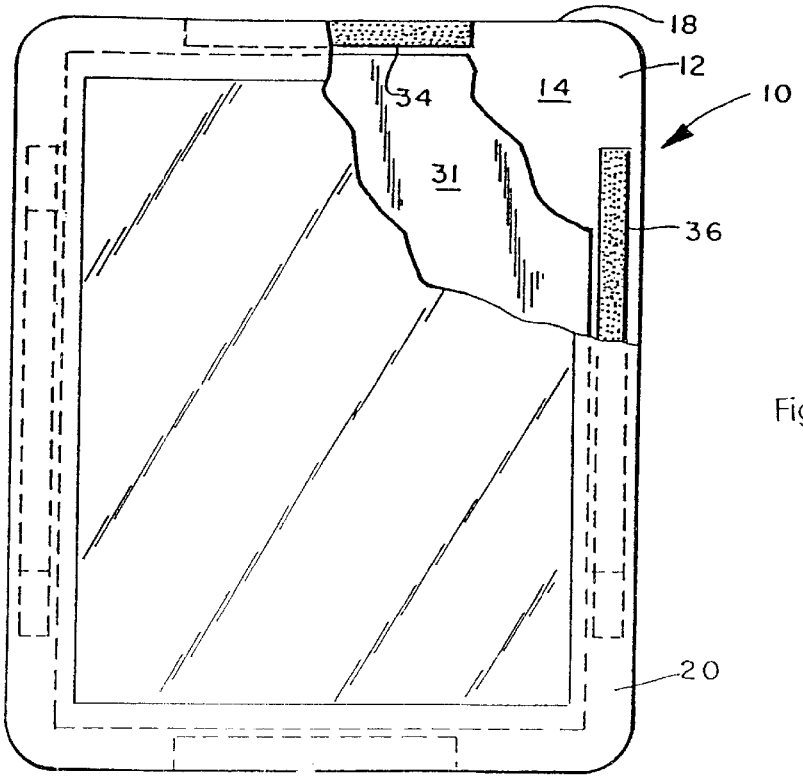
FIG. 1 is a front elevational view of a display holder according to the present invention.
Figure 2:
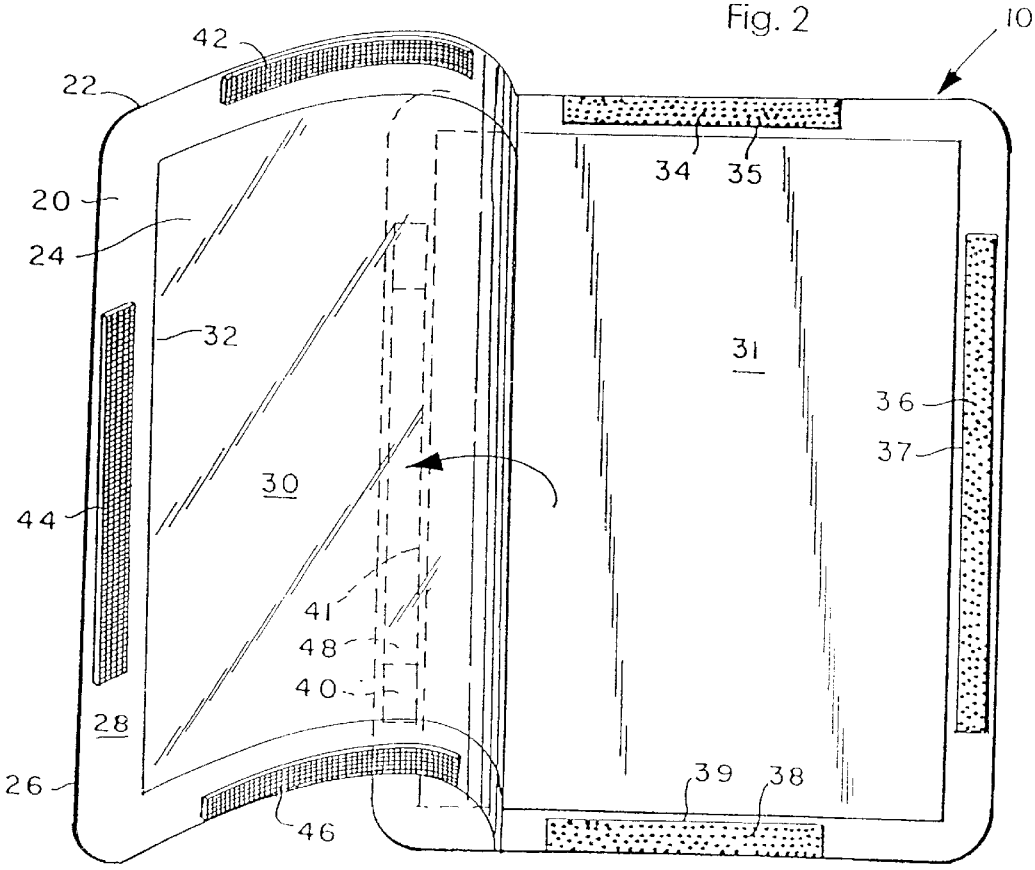
FIG. 2 is a perspective view of the holder of FIG. 1 showing the cover of the holder partially separated from the underlying board.
Figure 3:
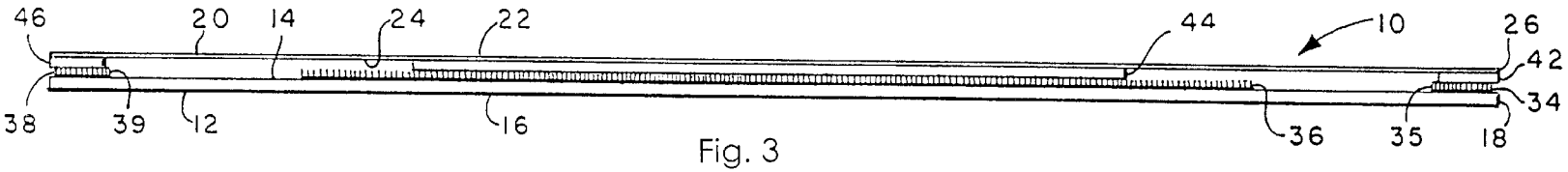
FIG. 3 is a side elevational view of the holder shown in FIG. 1.
Figure 4:
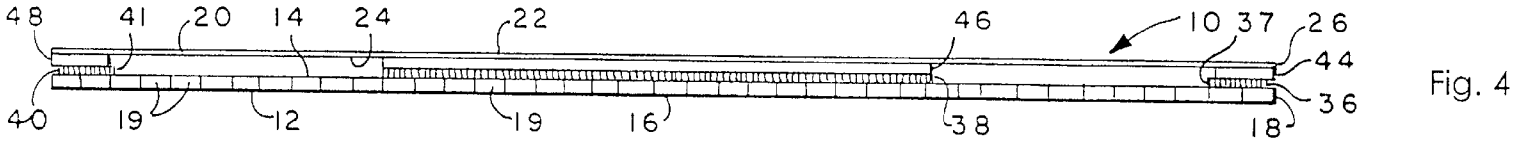
FIG. 4 is an end elevational view of the holder shown in FIG. 1.

Referring now to the drawings, wherein the showings are for the purpose of illustrating several preferred embodiments of the subject invention only and not for the purpose of limiting same, FIGS. 1–5 show a display holder designated generally by the numeral 10 comprising a board or substrate 12 having a front surface 14, a rear surface 16 and an outer edge 18. As shown in FIGS. 3 and 4, board 12 is preferably formed from a thin corrugated material such as laminated paperboard or plastic. A plurality of channels 19 formed in board 12 reduce the weight of board 12 while at the same time conferring a substantial degree of rigidity thereto. Holder 10 further comprises a cover 20 having a front surface 22, a rear surface 24, and an outer edge 26. Cover 20 includes an opaque frame portion 28 extending inwardly: from outer edge 26 of cover 20 a small distance, such as an inch for example, and an inner transparent section 30. Transparent section 30 may be formed from a separate piece of material that is then attached to frame portion 28 in any suitable manner. However, it is preferred that cover 20 be made from a unitary piece of transparent material and that the frame portion 28 be tinted or coated in a suitable manner to make it opaque. An inner frame 32 is formed at the junction of frame portion 28 and inner transparent portion 30. A sheet of paper 31 is shown in holder 10 in FIGS. 1 and 2. Transparent portion 30 of cover 20 is made from a material suitable for use with erasable markers which allows annotations to be added to paper 31 without physically altering the paper.

First, second, third and fourth portions 34, 36, 38, 40 of a fastener material are connected to front surface 14 of board 12 in close proximately to and parallel to outer edge 18 in a suitable manner such as by gluing. While these fasteners are prefer ably the loop type portion of a hook and loop fastener, such as those sold under the trademark "Velcro," it should be understood that magnetic fasteners or low tack adhesive fasteners that include a surface raised with respect to the board could be substituted for the hook and loop fasteners: without departing from the scope of the invention. For simplicity, the fasteners will be described herein as "hook and loop type fasteners." First, second, third and fourth portions of loop type fastener 34, 36, 38 and 40 include inner side walls 35, 37, 39 and 41 respectively which define a display area on the front surface of board 12. While any size of paper smaller than the dimensions of this area can be displayed with the subject holder, it is preferred that a holder be used wherein the dimensions of the display area are only slightly greater than the dimensions of a paper to be displayed. For example, when letter size 8½ by 11 inch paper is being displayed, the dimensions of the display area should be approximately 8⅝ by 11⅛ inches. When the fastener portions 34, 36, 38 and 40 are arranged in this manner, they can be used to properly align a paper on surface 14. Side walls 35, 37, 39 and 41 then limit relative movement between the paper and board 12 while cover 20 is attached to the board. These side walls thus serve to support a paper even when the board is held in a nearly vertical position which makes it much easier to properly place papers on the board for display. Preferably, the dimensions of the area 30 within inner frame 32 are slightly smaller than the dimensions of the paper being displayed. In this manner, none of the information on the paper is hidden by opaque frame portion 28 but the edges of the paper are covered to present a neat, professional appearance.

First, second, third and fourth segments 42, 44, 46, 48 of hook type fastener material are attached to back surface 24 of cover 20 parallel to outer edge 26, on the frame portion 28 and positioned so that they will overlay first, second, third and fourth sections 34, 36, 38, 40 of the loop type fastener on board 12. Hook type fastener sections 42, 44, 46, 48 can be attached to back surface 24 of cover 20 by any suitable means such as by gluing. When cover 20 is placed over board 12 with the hook and loop type fasteners on the respective portions aligned, and the board and cover are pressed together, the hook and loop type fastener portions hold the cover securely in place with the paper to be displayed held in between. Frame portion 18 is opaque and therefore hides the hook and loop fasteners from view when the cover is attached to the board in this manner.

In order to use the subject display holder, cover 20 must be partially or entirely separated from board 12 in order to allow paper 31 or similar thin material to be inserted into the holder. As shown in FIG. 2, hook type fasteners 42, 44 and 46 can be separated from loop type fasteners 34, 36, 38 while leaving fasteners 40 and 48 connected. Cover 20 is flexible and may be flexed about fourth fasteners 40, 48 to expose front surface 14 of board 12. Paper 31 is then be laid upon board 12 within the display area between the loop type fasteners thereon and cover 20 is returned to a position overlying board 12 with all the hook and loop fasteners engaged with one another.

Each of the hook type fasteners 42, 44, 46, 48 can be independently disengaged from each of the loop type fasteners 34, 36, 38, 40. This allows for an alternate method of use in which only one of the fastener pairs is separated to create an opening between the cover and board to allow paper 31 to be removed from the holder between the hook and loop type fasteners. This method may be especially useful when the material being displayed has some rigidity, such as cardboard or paperboard, and which can therefore be inserted and removed without folding the edges or otherwise damaging the material.

Figure 8:
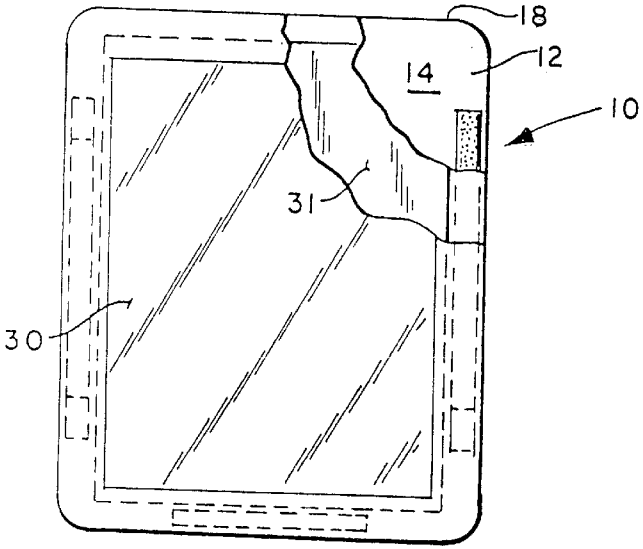
FIG. 8 is a front elevational view of a second embodiment of the subject holder.

In a second embodiment shown in FIG. 8, fasteners are provided along only three sides of cover 20 and board 12 leaving a space between the cover and the board along one side thereof. Preferably loop fasteners 36, 38, 40 are attached to board 12 and hook fasteners 44, 46, 48 are attached to the cover which leaves open space at the top of the holder for the insertion of documents. Of course, the cover can also be separated from the board as described above when the documents being displayed cannot easily be inserted and removed in this manner.

Figure 9:
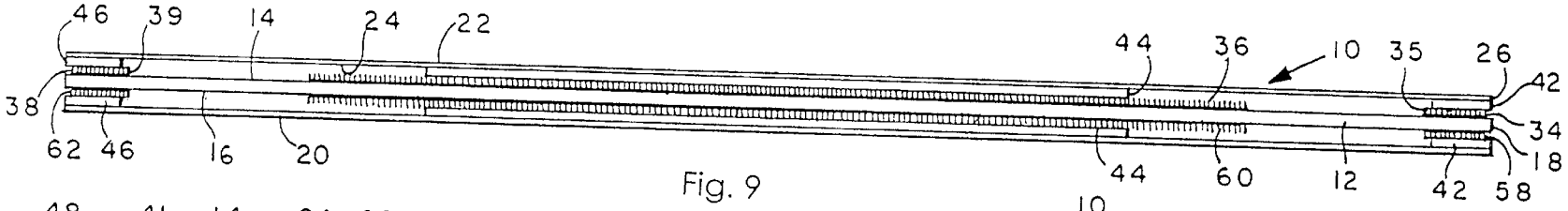
FIG. 9 is a side elevational view of a third embodiment of the subject holder.
Figure 10:
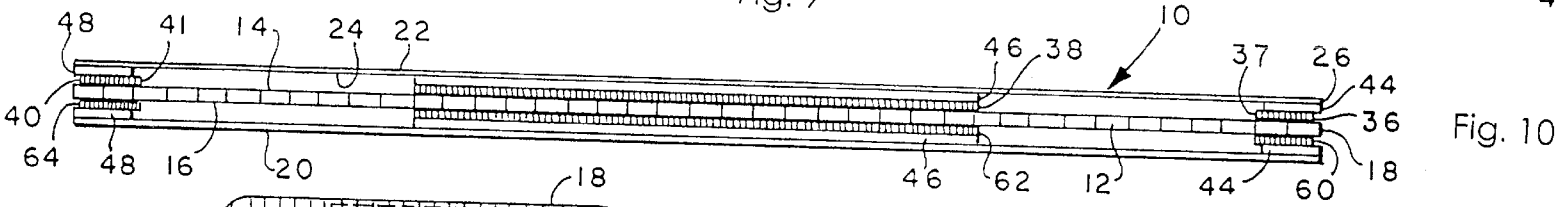
FIG. 10 is an end elevational view of the holder shown in FIG. 9.

In a third embodiment of the subject invention shown in FIGS. 9 and 10, rear surface 16 of board 12 is provided with four segments of loop type fastening material 58, 60, 62 and 64 generally opposite from loop type fastening material 34, 36, 38, 40 on the front surface of the board so that a second cover 20 can be attached to rear surface 16. In this manner, the same board 12 can be used to display two different items of information at the same time to allow on a person using display holder 10 to flip back and forth quickly and surely between two displays.

Figure 13:
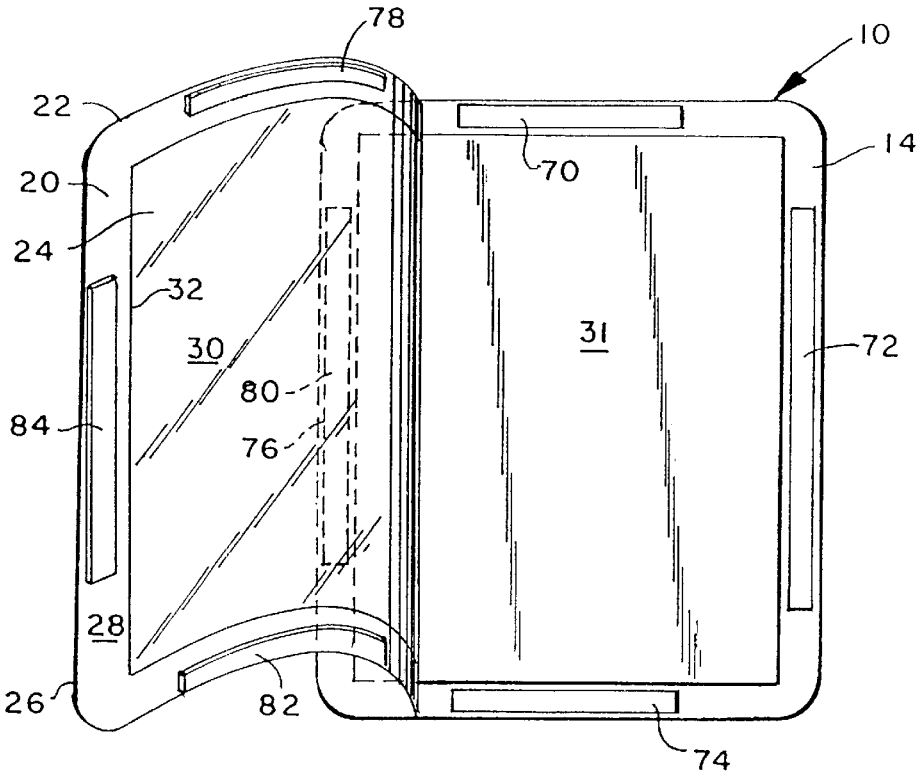
FIG. 13 is a perspective view of a fourth embodiment of the subject holder.

In a fourth embodiment, shown in FIG. 13, the hook and loop fasteners of the prior embodiments are replaced with a plurality of magnets on cover 20 and raised ferromagnetic portions on board 12. Specifically, board 12 includes first, second, third and fourth ferromagnetic elements 70, 72, 74, 76 suitably fastened along the edges of board 12 such as by gluing. Corresponding magnets 78, 80, 82, 84 are suitably attached around the periphery of cover 20 so that they will overlay the ferromagnetic regions 70, 72, 74, 76 when the cover is placed over the board. The holder otherwise can be used in the same manner as the holder described in the first embodiment.

Figure 14:
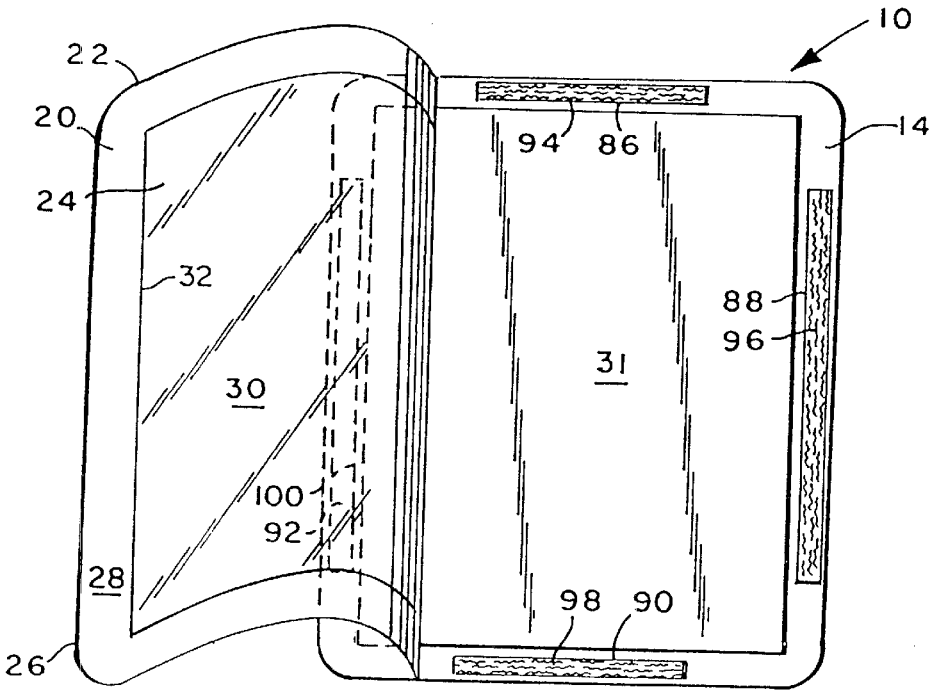
FIG. 14 is a perspective view of a fifth embodiment of the subject holder; and, FIG. 15 is a front elevational view of the frame portion of the holder shown in FIG. 13.
Figure 15:
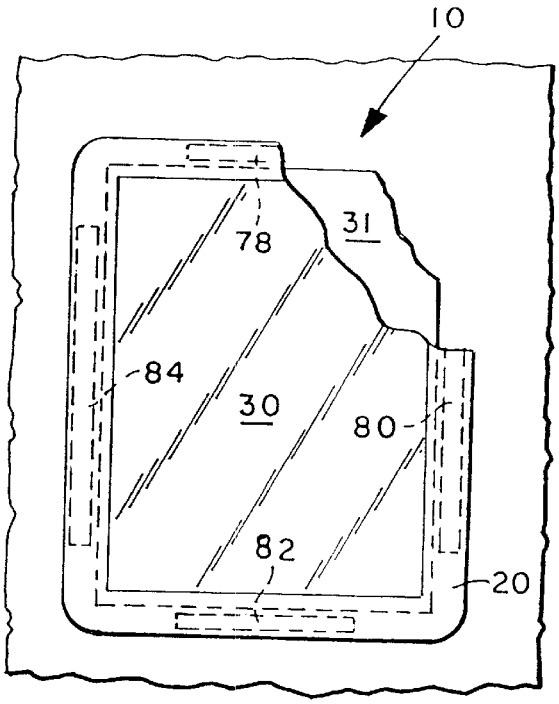

In a fifth embodiment, shown in FIG. 15, a low tack adhesive is used to secure cover 20 to board 12. As seen in FIG. 14, first, second, third and: fourth foam members 86, 88, 90, 92 are positioned around the periphery of board 12. These members are raised with respect to the board and thus help to limit relative motion between paper 31 and board 12 as described with respect to the previous embodiments. The foam members are permanently secured to board 12 such as by gluing, and include top walls 94, 96, 98, 100 parallel to and spaced apart from top surface 14 of board 12. These top walls 94, 96, 98, 100 are coated with a low tack adhesive similar to the adhesives found on self-adhesive notes. These low tack adhesives are strong enough to hold cover 20 to board 12, but also allow the cover to be peeled away from the foam members and replaced repeatedly without damaging the foam or the cover. The adhesive bonds directly to the periphery of cover 20 and no additional attachment mechanisms are needed on cover 20 in this embodiment.

Figure 6:
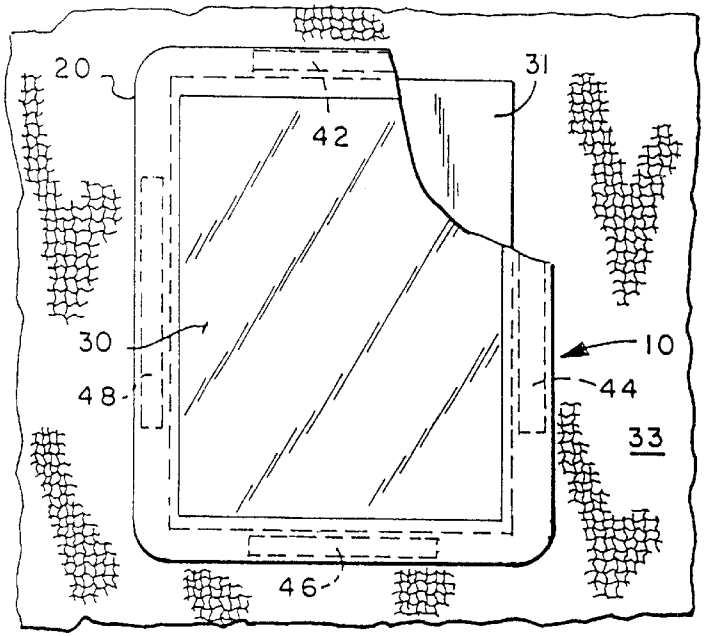
FIG. 6 is a front elevational view of the frame portion of the holder shown in FIG. 1 mounted directly on a fabric covered wall.
Figure 5:
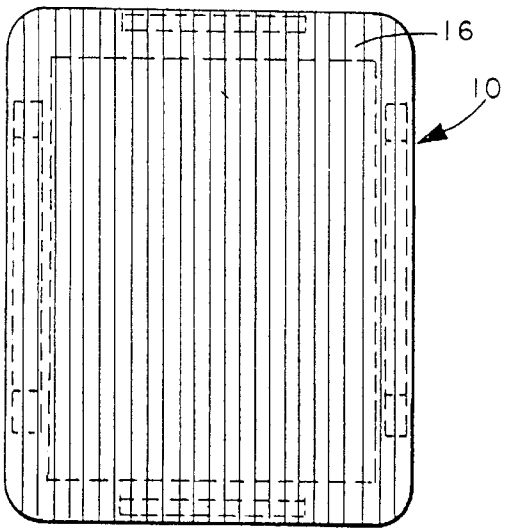
FIG. 5 is a rear elevational view of the holder shown in FIG. 1.
Figure 11:
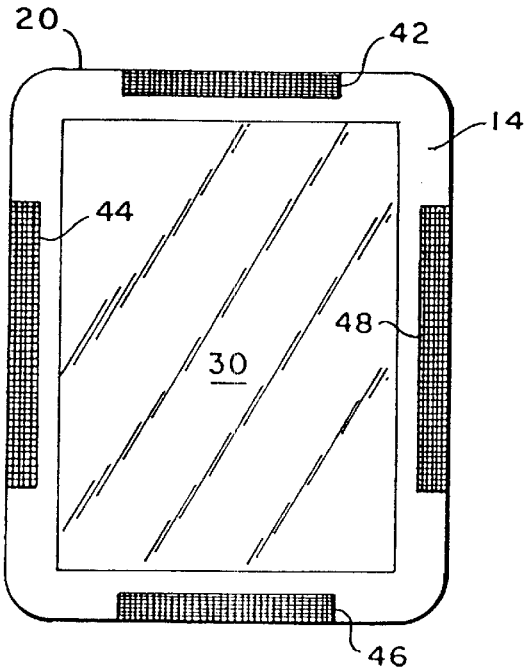
FIG. 11 is a rear elevational view of the cover shown in FIG. 6.

As shown in FIGS. 6 and 11, frame 20 can also be used to attach document 31 to a fabric covered wall or other surface 33. This can be useful in office cubicles or on fabric covered pin boards and allows a document to be mounted without making holes in it. Because the hook type fasteners 42, 44, 46, 48 are raised with respect to the frame 20, they also serve to hold a document in a proper orientation when it is being placed on the wall.

To use frame 20 to secure a document to a fabric covered wall, paper 31 is first placed against rear surface 24 of the cover 20 between the hook type fasteners 42, 44, 46, 48 and held in place as the frame is moved toward surface 33. When the fastener 46 on the bottom edge of the frame contacts surface 33, it forms a stop between the cover and the surface to prevent paper 31 from sliding down the wall. The user's fingers can then be removed from behind the frame as the remaining fasteners are pressed against surface 33. Because all of the fasteners are raised with respect to back surface 24 of cover 20, the paper 31 is held securely and will not rotate with respect to the cover.

An alternate method of using the subject invention to secure a document to a wall is to position frame 20 on a wall in a desired location and orientation and then peel three sides of the frame off of the wall to leave only bottom side fastener 46 connected thereto. Paper 31 on a similar item can then be placed behind cover 20 within the area defined by fasteners 42, 44, 46, 48, resting on bottom fastener 48. The remaining fasteners can then be reattached to the wall as described above. Beneficially, attaching the frame in this manner allows the user to first position the frame exactly as desired without having to hold paper 31 behind the cover. The paper can be inserted after the positioning has been accomplished.

Figure 12:
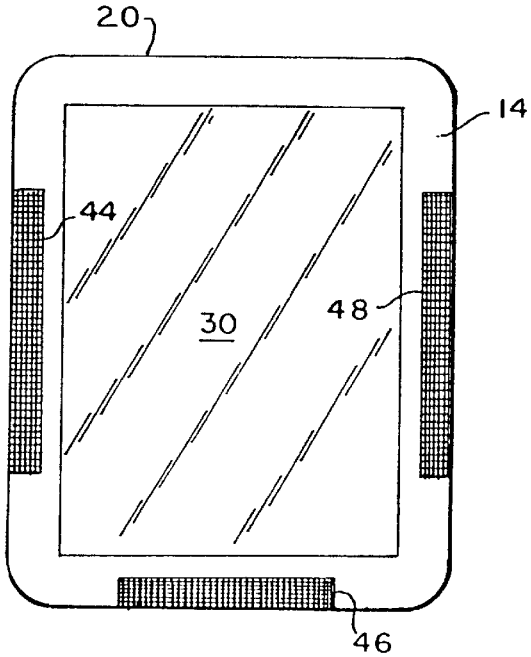
FIG. 12 is a rear elevational view of the cover shown in FIG. 8.

The frame of the second embodiment, shown in FIG. 12, can also be used to hold documents against a fabric covered surface. In this embodiment, fastener 42 on the top edge of cover 20 is removed to leave an opening between the cover and the fabric covered wall. The absence of this fastener does not affect the performance or manner of use of the frame described above; however, it does allow for the easy insertion and removal of paper 31 or similar materials without removing frame 20 from the wall. This can be useful, for example, when frame 20 is used to display a calendar, or other multi-page document, certain pages of which must be removed or changed periodically.

FIG. 15 shows how the frame with attached magnets 78, 80, 82, 84 can be used to hold a document 31 against a ferromagnetic surface, such as a metal filing cabinet or the surface of some chalkboards. The cover functions in the same manner as the cover in FIG. 6 but is useful on ferromagnetic surfaces rather than fabric covered surfaces.

Figure 7:
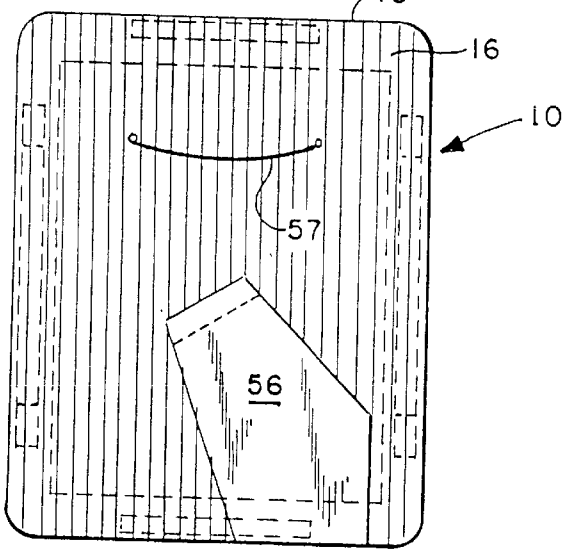
FIG. 7 is a rear elevational view of the holder shown in FIG. 1 which includes a brace for making the holder freestanding.

FIG. 7 shows a modification that can be made to the first, second, fourth or fifth embodiment of the subject display holder to convert the:holder into a freestanding display or to allow it to be mounted on a wall. A hinged brace 56 is connected to rear surface 16 of board 12 which can be folded out from the rear surface to brace the holder and make it freestanding. The brace can be folded against the back surface for easy storage or when the brace is not needed. A wire or string 57 is also connected to back wall 16 in any suitable manner to allow the display to be hung on a nail or wall hook.

The subject invention has been described with respect to several preferred embodiments thereof, it being understood that obvious modifications will occur to those skilled in the art upon a reading and understanding of the foregoing disclosure. All these modifications are included within the scope of this invention to the extent that they are included within the scope of the claims appended hereto.

I claim:

1. A display assembly comprising:

a fabric-covered surface;

a cover having a front side, a rear side, a transparent central portion, a peripheral portion, and fastener elements positioned on the rear side along the peripheral portion for selective engagement to the fabric-covered surface; and a document positioned adjacent the transparent central portion between the rear side of the cover and the fabric-covered surface;

whereby the document is supported in a defined retention area between the cover and the fabric-covered surface.

2. The display assembly of claim 1 wherein the peripheral portion is opaque.

3. The display assembly of claim 1 wherein the transparent central portion is adapted to be written upon by erasable markers.

4. The display assembly of claim 1 wherein the fastener elements define a opening along the peripheral portion where no fasteners are located.

5. The display assembly of claim 1 wherein the fastener elements are hook-type fasteners.

6. The display assembly of claim 1 wherein the cover is a unitary flexible sheet of material.

7. A method of removably securing a document in a fixed relationship to a fabric-covered surface, the method comprising:

providing a cover having front and rear sides, a transparent central portion, a peripheral portion and fastener elements positioned on the rear side along the peripheral portion for selective engagement to the fabric-covered surface;

positioning the document adjacent the central portion of the rear side;

placing the cover on the fabric-covered surface at a desired location and in a desired orientation so that the fasteners engage the fabric-covered surface.

8. The method of claim 7 wherein the peripheral portion is opaque.

9. The method of claim 7 wherein the transparent central portion is adapted to be written upon by erasable markers.

10. The method of claim 7 wherein the fastener elements are hook-type fasteners.

11. The method of claim 7 wherein the cover is a unitary flexible sheet of material.

12. The method of claim 7 wherein the fastener elements define a opening along the peripheral portion where no fasteners are located.

13. The method of claim 12 wherein the document is positioned adjacent the central portion of the rear side by sliding the document through the opening after the cover is placed on the fabric-covered surface and the fasteners engage the fabric-covered surface.

14. The method of claim 7 wherein the document is positioned adjacent the central portion of the rear side before the cover is placed on the fabric-covered surface and the fasteners engage the fabric-covered surface.

* * * * *